US011286754B2

(12) United States Patent
Mathis et al.

(10) Patent No.: US 11,286,754 B2
(45) Date of Patent: Mar. 29, 2022

(54) LANDING SYSTEM FOR SUBSEA EQUIPMENT

(71) Applicant: Neodrill AS, Stavanger (NO)

(72) Inventors: Wolfgang Mathis, Sandnes (NO); Harald Strand, Algard (NO); Ole Kristian Holen, Tau (NO)

(73) Assignee: Neodrill AS, Stavanger (NO)

( * ) Notice: Subject to any disclaimer, the term of this patent is extended or adjusted under 35 U.S.C. 154(b) by 0 days.

(21) Appl. No.: 17/155,546

(22) Filed: Jan. 22, 2021

(65) Prior Publication Data

US 2021/0140279 A1 May 13, 2021

Related U.S. Application Data

(63) Continuation of application No. PCT/IB2019/056293, filed on Jul. 23, 2019.

(60) Provisional application No. 62/702,548, filed on Jul. 24, 2018.

(51) Int. Cl.

| | |
|---|---|
| ***E21B 41/08*** | (2006.01) |
| ***E21B 33/038*** | (2006.01) |
| ***E21B 41/10*** | (2006.01) |

(52) U.S. Cl.

CPC ..... *E21B 41/08* (2013.01); *E21B 33/038* (2013.01); *E21B 41/10* (2013.01)

(58) Field of Classification Search

CPC ..... E21B 33/038; E21B 41/08; E21B 41/10

See application file for complete search history.

(56) References Cited

U.S. PATENT DOCUMENTS

| | | | | | |
|---|---|---|---|---|---|
| 3,358,753 | A | * | 12/1967 | Haeber | E21B 41/10 166/343 |
| 3,744,561 | A | | 7/1973 | Shatto et al. | |
| 4,046,192 | A | | 9/1977 | Darnborough et al. | |
| 4,127,991 | A | * | 12/1978 | Regan | E21B 7/128 175/7 |
| 4,171,922 | A | * | 10/1979 | Coulboy | E21B 33/038 405/169 |
| 4,347,900 | A | * | 9/1982 | Barrington | E21B 33/038 166/380 |
| 4,537,533 | A | * | 8/1985 | Hampton | B63B 21/50 405/205 |
| 4,702,320 | A | | 10/1987 | Gano | |
| 5,163,783 | A | | 11/1992 | Fahrmeier | |
| 6,062,312 | A | | 5/2000 | Wilkins | |

(Continued)

OTHER PUBLICATIONS

International Search Report, International Application No. PCT/IB2019/056293 dated Nov. 21, 2019.

(Continued)

*Primary Examiner* — Aaron L Lembo

(74) *Attorney, Agent, or Firm* — Richard A. Fagin

(57) ABSTRACT

A landing system for subsea equipment includes a heavy component having a latch affixed thereto and having a mechanism attached to enable lowering the heavy component from a platform above the bottom of a body of water. A landing system frame has a connection point matable with the latch. A linear motor is functionally coupled to the landing system frame and at least one of the subsea well structure and a movable frame on the landing system. The linear motor is operable to control a distance between the landing system frame and the subsea well structure or the movable frame.

23 Claims, 3 Drawing Sheets

(56) References Cited

U.S. PATENT DOCUMENTS

| | | | | |
|---|---|---|---|---|
| 6,142,233 | A * | 11/2000 | Wilkins | E21B 33/038 166/339 |
| 7,370,707 | B2 * | 5/2008 | McDaniel | E21B 19/004 166/380 |
| 8,857,520 | B2 * | 10/2014 | Hoffman | E21B 33/038 166/351 |
| 8,931,561 | B2 * | 1/2015 | Baker | E21B 19/002 166/341 |
| 9,500,053 | B2 * | 11/2016 | Leuchtenberg | E21B 21/08 |
| 9,631,442 | B2 * | 4/2017 | Bansal | E21B 19/16 |
| 9,702,220 | B2 * | 7/2017 | Hall | E21B 33/035 |
| 9,976,364 | B2 * | 5/2018 | Shilling, III | B63B 35/4413 |
| 10,119,353 | B2 * | 11/2018 | Mullins | E21B 43/013 |
| 10,738,555 | B2 * | 8/2020 | Cummins | E21B 33/06 |
| 10,883,338 | B2 * | 1/2021 | Bhadbhade | E21B 34/06 |
| 11,028,549 | B2 * | 6/2021 | Kannegaard | E21B 41/0007 |
| 2012/0043089 | A1 * | 2/2012 | Hoffman | E21B 33/076 166/340 |
| 2017/0191334 | A1 * | 7/2017 | Jaffrey | E21B 33/064 |

OTHER PUBLICATIONS

Written Opinion of the International Search Authority, International Application No. PCT/IB2019/056293 dated Nov. 21, 2019.

Examination Report dated Aug. 2, 2021, for Australian Patent Application No. 2019311385.

* cited by examiner

LANDING SYSTEM FOR SUBSEA EQUIPMENT

CROSS REFERENCE TO RELATED APPLICATIONS

Continuation of International Application No. PCT/IB2019/056293 filed on Jul. 23, 2019. Priority is claimed from U.S. Provisional Application No. 62/702,548 filed on Jul. 24, 2018. Both the foregoing applications are incorporated herein by reference in their entirety.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable.

BACKGROUND

This disclosure relates to the field of devices that safely land a blowout preventer (BOP) or other heavy equipment deployed from a platform or ship on the water surface onto a wellhead of a subsea well or any other water bottom deployed component that may require engagement of another device from the water surface.

International Application Publication No. WO 2011/162616 describes a device to support a subsea BOP in operational condition. When establishing a subsea well the following principal steps may be executed:

1. Install and secure a well foundation, which may be a conventional conductor of 30 to 48 inch diameter pipe that may be installed in the water bottom by drilling and cementing, driving, or jetting into the water bottom. A well foundation such as the CAN foundation, as described in International Application Publication No. WO 2010/0068119 may be used. CAN is a registered trademark of Neodrill AS, Stavanger, Norway.
2. Extend the depth of the well, run and cement a surface casing which holds a high pressure housing.
3. Run the BOP and connect it to the high pressure housing.
4. Extend the depth of the well, run and cement one or more successive casing strings.

Steps 1 and 2 are usually performed with drilling fluid returns to the surrounding water mass or with a riserless mud recovery system. An embodiment of a riserless mud recovery system is sold under the trademark RMR, which is a registered trademark of Enhanced Drilling AS, Straume, Norway. When performing step 3, the BOP, which may have a mass of 250-500 metric tons, is lowered from the platform or ship, e.g., a drilling vessel, through the splash zone, through the water column toward the installed subsea well components. The most critical operation during this step 3 is the last element, which is to connect the BOP to the well. For this step, the BOP is equipped with a connector that fits a profile of the high pressure housing. Similar operations may be performed at later stages in well construction, for example, when landing a LMRP (lower marine riser package) onto the BOP, or when landing a christmas tree (valve assembly) onto the wellhead.

Environmental conditions have an influence on the vessel that installs the BOP, in particular when the vessel is a floating platform. The floating vessel or platform, and consequently the BOP, undergoes movement relative to the well or other water bottom equipment, which is fixed on the water bottom. Environmental conditions that influence the relative movements of the BOP during latching operations include: wind, wave action, surface water currents, subsurface water currents and vibrations caused by currents around the riser (vortex induced vibrations) among other conditions. During the landing process aligning a connector with the high pressure well head housing (HPWHH) is critical. It must be ensured that none of the components are damaged. A sealing assembly between the connector and the HPWHH is exposed to full well pressure in case of a well control event, depending on the BOP rating, which may implicate pressure in the range of 5000 to 20000 pounds per square inch (psi). It would have catastrophic consequences (e.g., hydrocarbon leaks to the environment) if the sealing assembly is compromised. It is common practice to test the sealing assembly before any drilling activity is initiated after connection of the connector, but a leaking sealing assembly would require the BOP to be pulled to surface to inspect the connector and the sealing assembly as well requiring use of a remotely operated vehicle (ROV) to inspect the sealing surface on the HPWHH. Replacement of the sealing assembly itself would be a minor cost factor, however, repair of the connector could lead to several days of delay. Both of the foregoing delay times would be in addition to the time required to pull the BOP to surface and to run and latch the BOP again, which in itself may be several days. Damage to the HPWHH may necessitate a well re-spud, potentially resulting in 1-2 weeks of lost rig time or more. Because of the high total daily cost for marine drilling unit operation, such a repair or re-spud may be very expensive.

Guide wire and guide post systems are used in shallow and medium water depth, for example as described in U.S. Pat. No. 4,611,661 issued to Hed et al., but usually not in deeper water depths. Increasing water depth results in operational challenges for guide wire systems, For example, subsurface currents may tangle the guide wires. Deep-water landing systems are therefore equipped with a funnel to assist the relative positioning and latching operation between the BOP and the HPWHH. The function of both systems is to limit relative lateral movements between the BOP and the HPWHH.

To limit vertical movement of drilling tools resulting from movement of the platform, the drilling tool hoisting system on typical floating drilling platforms use an active heave compensation system. Such a system may comprise a MRU (motion reference unit) that measures roll, pitch, yaw and heave motions of the platform or vessel. The motion information is used to actively steer the hoisting system of the vessel to stabilize the relative vertical movement of the load hanging in the hoisting system, e.g., drilling tools, riser, LMRP and BOP. If a wave pushes the vessel upwards, the active heave compensation system will instruct the hoisting system to pay out wire (or the like in case of wire-less systems) to compensate for the vessel movement in upward direction (and vice-versa). The theoretical result is that the load suspended in the hoisting system will be substantially decoupled from the vertical vessel motion and remain stationary with referenced to a fixed elevation point, such as the HPWHH on the water bottom. However, there are operational limitations to the accuracy of active heave compensation systems which in practice results in reduced relative vertical movement with reference to the water bottom, but not in zero relative vertical movement.

Despite the use of a guide wire system and/or guide funnel for lateral movement control and the active heave compensation system for vertical movement limitation, heavy equipment landing systems known in the art have practical limits. It is therefore not uncommon that a BOP landing and latching operation has to be suspended in adverse environmental conditions until such conditions improve. Therefore the environmental conditions to enable safe landing/disconnection operations are limited to prevent impact and damage to the connector and the HPWHH. Suspended operations have associated costs.

SUMMARY

A landing system for a subsea structure according to one aspect of the present disclosure includes a heavy component having a latch affixed thereto and having a mechanism attached to enable lowering the heavy component from a platform above the bottom of a body of water. A landing system frame comprises a connection point matable with the latch. A linear motor functionally is coupled to the landing system frame and at least one of the subsea well structure and a movable frame on the landing system. The linear motor is operable to control a distance between the landing system frame and the at least one of the subsea structure and the movable frame on the landing system.

In some embodiments, the heavy component comprises a blowout preventer.

Some embodiments further comprise a connector associated with the blowout preventer, a seal assembly disposed in the connector and a seal bore extension coupled to an upper end of the subsea well, the connector and the seal bore extension sealing engaged when the linear motor is retracted.

Some embodiments further comprise a damper disposed between the heavy component and the landing system frame.

In some embodiments, the damper comprises a piston engaged with a cylinder, the cylinder comprising a flow restrictor such that water is restrictedly movable through the cylinder in response to motion of the piston.

In some embodiments, the damper is tuned to be critically damped based on mass of the heavy component and a spring constant of the mechanism.

In some embodiments, the linear motor comprises an hydraulic piston and cylinder.

In some embodiments, the linear motor comprises a jack screw and ball nut.

Some embodiments further comprise a damper having a first component coupled to the heavy component and a second component coupled to the landing system frame.

In some embodiments, the landing system frame is affixed to the subsea structure.

In some embodiments, the subsea structure comprises a subsea well.

In some embodiments, the landing system frame is affixed to the heavy component to be landed on the bottom of water.

A method for landing a heavy component on to a subsea structure according to another aspect of this disclosure includes lowering the heavy component having a latch affixed thereto from a platform above the bottom of a body of water, wherein the subsea structure comprises a landing system frame. The landing system frame comprises a connection point matable with the latch, and a linear motor functionally coupled to the landing system frame and at least one of the subsea structure and a movable frame on the landing system. The linear motor is operable to control a distance between the landing system frame and the at least one of the subsea well structure and the movable frame on the landing system. The latch is locked to the connection point. The linear motor is operated to move the heavy component toward the subsea structure.

In some embodiments, the heavy component comprises a blowout preventer.

Some embodiments further comprise a connector associated with the blowout preventer, a seal assembly disposed in the connector and a seal bore extension coupled to an upper end of the subsea well, the connector and the seal bore extension sealing engaged when the linear motor is retracted.

Some embodiments further comprise damping movement using a damper disposed between the heavy component and the landing system frame.

In some embodiments, the damper comprises a piston engaged with a cylinder, the cylinder comprising a flow restrictor such that water is restrictedly movable through the cylinder in response to motion of the piston.

In some embodiments, the damper is tuned to be critically damped based on mass of the heavy component and a spring constant of the mechanism.

In some embodiments, the linear motor comprises an hydraulic piston and cylinder.

In some embodiments, the linear motor comprises a jack screw and ball nut.

In some embodiments, the landing system frame is affixed to the subsea structure.

In some embodiments, the subsea structure comprises a subsea well.

In some embodiments, the landing system frame is affixed to the heavy component to be landed on the bottom of water.

DETAILED DESCRIPTION

A landing system as described herein may be used as a landing aid for blowout preventers (BOPS) and other "heavy" components used in connection with a subsea well or any other marine structure disposed on the bottom of a body of water. Activities that may use the system disclosed herein may include, without limitation, the landing and retrieval of subsea pumps, gas compression units, separation units and the like.

Figure 1:
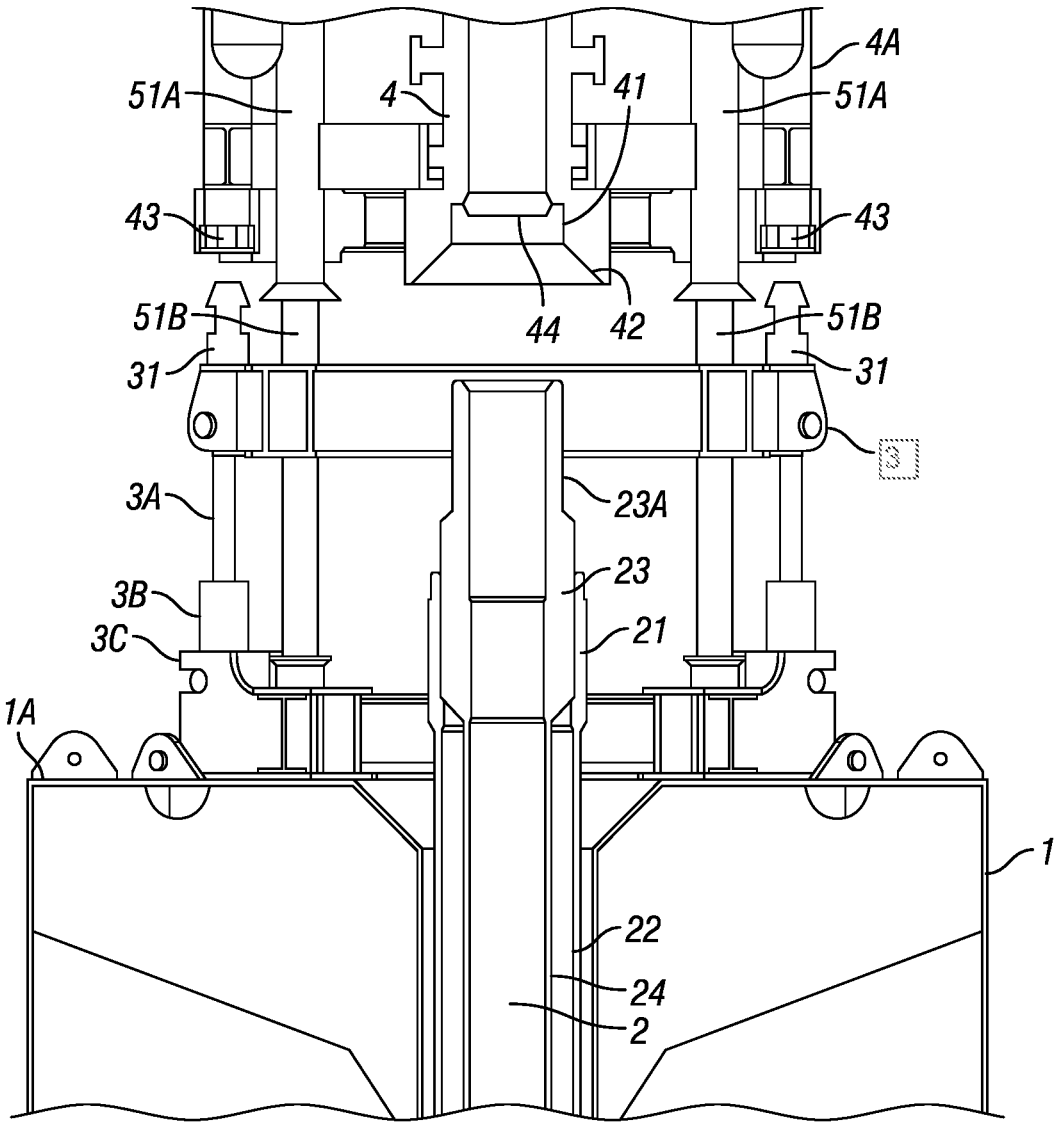
FIG. 1 shows an example embodiment of a landing system wherein heavy components are being lowered onto a subsea well.

Referring to FIG. 1, an example landing system and subsea structure, in this example embodiment, a subsea well according to the present disclosure will be explained. A subsea well 2 may comprise a conductor pipe 22 supported by a well support, comprising, for example, an anchor 1 such as a suction anchor. A top plate 1A may be disposed in or on the anchor 1, and may laterally support the conductor pipe 22, a surface casing 24 and a high pressure wellhead housing (HPWHH) 23. The HPWHH 23 may comprise a seal bore extension and/or latching profile 23A to sealingly engage a seal assembly 44 and connector 41 forming part of one or more heavy components, which in the present example embodiment may comprise a blowout preventer (BOP) 4 disposed in a BOP frame 4A along with a connector 41 and the seal assembly 44. A landing system lower frame 3C may be coupled to the anchor 1 in any known manner. The landing system lower frame 3C may have coupled thereto one or more linear motor components, 3A, 3B, for example, comprising hydraulic cylinders or ball nuts 3B coupled to the landing system lower frame 3C and corresponding pistons or jack screws (threaded rods) 3A operably engaged with the hydraulic cylinders or ball nuts 3B to enable precise control of the distance between a landing system upper frame 3 and the landing system lower frame 3C.

The BOP frame 4A may comprise one or more guides 51A that operably engage one or more corresponding guide posts 51B disposed on the landing system upper frame 3, and/or the landing system lower frame 3C (or as shown in FIG. 1 passing through the landing system upper frame 3 for orientation stability under load).

A challenge with a marine well equipment landing operation is that a very heavy component in motion, for example, the BOP 4, must be landed onto a fixed and very stiff component, for example, the high pressure wellhead housing (HPWHH) 23. The HPWHH 23 may be supported by a well foundation (e.g., the conductor pipe, suction anchor, etc.) and therefore may be very stiff, meaning the HPWHH 23 cannot undergo large horizontal and vertical deformations. Decelerating a heavy object such as the BOP 4 over a short distance during landing operations results in very high dynamic forces.

An intended result of landing heavy components such as the BOP 4 onto the HPWHH 23 according to the present disclosure is to lock the BOP frame 4A into the landing system upper frame 3 before the critical components, such as the connector 41 and the HPWHH 23, can be in physical contact with each other. Components in the landing system according to the present disclosure may subsequently provide well-controlled movement of the critical components (e.g., the BOP frame 4A, BOP 4 and HPWHH 23) toward each other such that motion that would be imparted by heave or waves to a platform on the water surface and corresponding motion of a riser or similar device connected to the platform is effectively isolated from such critical components. Such motion isolation may prevent damaging the critical components as they are finally connected to each other.

One embodiment of a landing system according to the present disclosure may utilize one or more dampers positioned proximate to connection points 31, for example a hydraulic piston system connected to a pressure compensator that is designed to act as a spring-suspension system. The hydraulic piston system may comprise a piston disposed in an hydraulic cylinder to allow a certain amount of movement within the landing system when high mass (heavy) components such as the BOP 4 are landed on the landing system, thereby decelerating the mass over a much longer distance and thus limiting the dynamic impact forces substantially. In other words, the landing system in this situation acts as a damper that gradually supports the BOP 4. Another embodiment may use sea water piston soft-landing dampers positioned proximate to connection points 31. The dampers can either be mounted on the BOP frame 4A or on the landing system, e.g., on the landing system frame 3. The dampers can either be combined with the connection points 31, or they can be separate devices near the connection points 31. The dampers may comprise a cylinder where a piston displaces seawater through narrow ports or similar flow restrictors during the landing sequence. The dampers may be optimized to suit the weight and intended landing speed of the heavy components (e.g., the BOP 4). Other types of dampers may be used in various embodiments. In some embodiments, the dampers may comprise the guides 51A and guide posts 51B, e.g., by having the guides 51A act as cylinders and the guide posts 51B act as pistons in a seawater displacement arrangement as described above.

The landing system connection points 31 may themselves be elastic or may be elastically coupled to an anchor base, e.g., the landing system upper frame 3, to limit the impact forces between, e.g., the BOP frame 4A and the landing system if a damping system is not present in any particular embodiment. The connecting points 31 may be configured to engage corresponding latches 43 on the BOP frame 4A. Cushions may be formed so that both lateral and vertical movements are transferred between the BOP frame 4A and the landing system, for example, cone shaped cushions. Features common to various embodiments of dampers are: The damping begins upon contact between the components suspended from the platform on the water surface, e.g., the BOP frame 4A and the components coupled to the subsea well, e.g., the landing system lower frame 3C and all components attached thereto. Some embodiments may comprise struts or the like. The dampers exert a vertical upward force onto the BOP frame 4A and a vertical downward force on the landing system lower frame 3C. The dampers may be tuned to absorb the required amount of kinetic energy at the lowest possible peak force, and ensure damping is critical damping, i.e., that the BOP 4 does not bounce with reference to the landing system upper frame 3 after the initial impact. Thus, a higher allowable initial impact velocity may be obtained, which increases the weather window, compared to a situation without the landing system upper frame 3.

Figure 2:
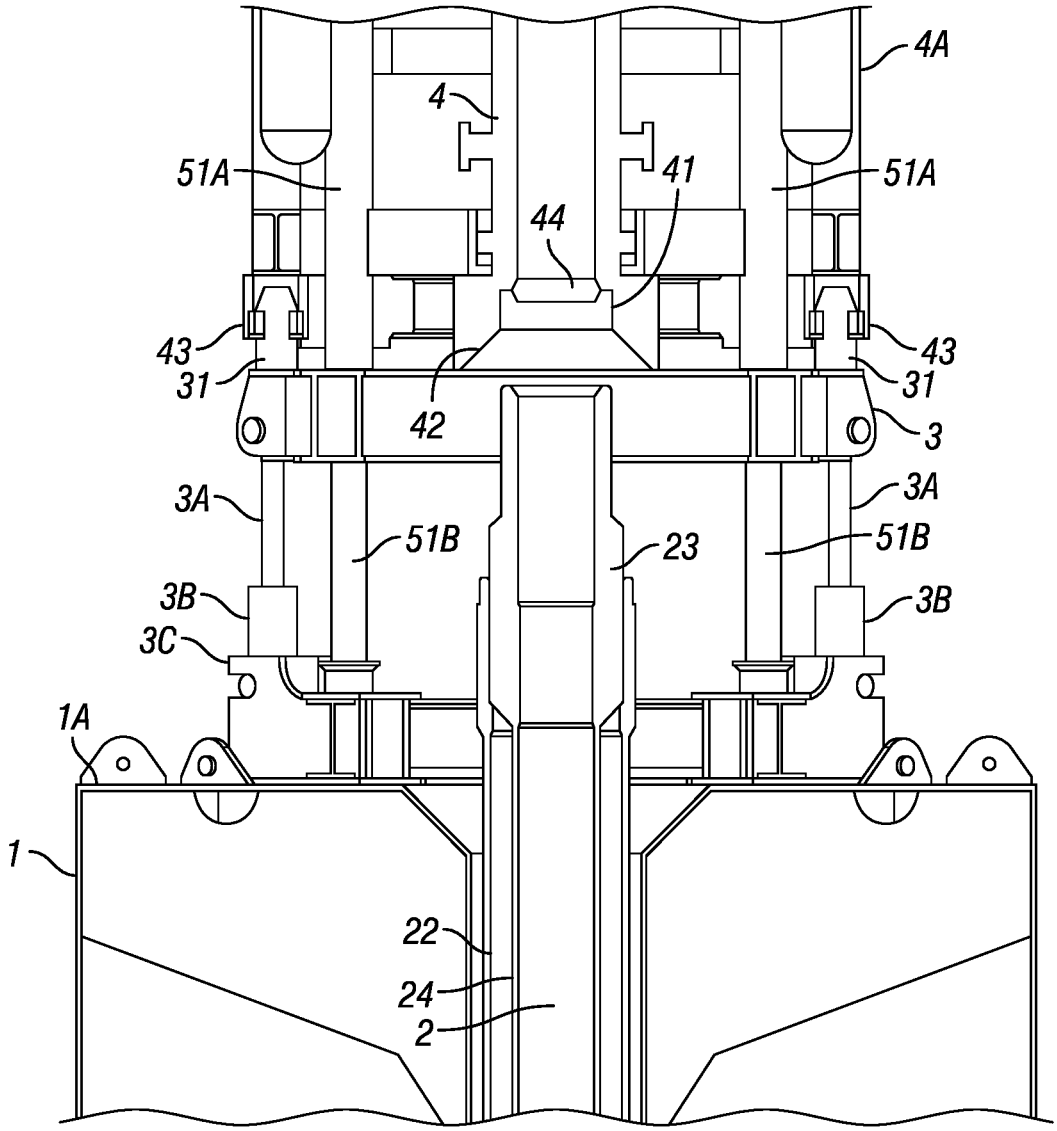
FIG. 2 shows the landing system of FIG. 1 wherein the heavy components are latched to the subsea well such that a connector is longitudinally spaced apart from a wellhead.

FIG. 2 shows the BOP frame 4A initially landed on the landing system upper frame 3. The critical components, e.g., the connector 41 and associated guide shoe 42 as well as the critical seal assembly 44, are not yet in contact with the HPWHH 23. Any impact resulting from relative motion between the BOP frame 4A and the landing system is absorbed by the dampers. Once the BOP 4 is safely landed onto the landing system upper frame 3, the connection points 31 may be locked or connected to the latches 43 to prevent relative movement between the BOP frame 4A and the landing system upper frame 3 caused by environmental forces.

A further benefit of such a latching mechanism is to provide a rigid connection between the BOP and the landing system for the BOP supporting function. An example of a BOP support is described in U.S. Pat. No. 9,410,089 issued to Strand.

Once the BOP frame 4A is safely latched to the landing system upper frame 3 any relative lateral or vertical movement between the BOP 4 and the well 2 is restricted by the landing system. This has also benefits with respect to VIV fatigue (vortex induced vibration related fatigue) as the landing system may be designed with sufficient structural stiffness to minimize issues with vibrations or harmonic motions in the BOP after it is latched onto the landing system.

The landing system may comprise components that can then be used to change the distance between the BOP frame 4A and the landing system lower frame 3C, and correspondingly, the connector 41 and the HPWHH 23, in a controlled manner without being subject to uncontrolled relative movements between the connector 41 and the HPWHH 23 caused by environmental influences. To reduce the distance in a controlled manner, the landing system may be equipped with a linear motor such as hydraulic pistons and corresponding cylinders, threaded rods and corresponding ball nuts (shown generally at 3A and 3B, respectively) or any similar devices that enable precise control of the distance between the connector 41 and the HPWHH 23 or any corresponding structures. The linear motor(s) may be remotely controlled from the surface via cable or wire-less communication, or controlled by ROV, etc.

Figure 3:
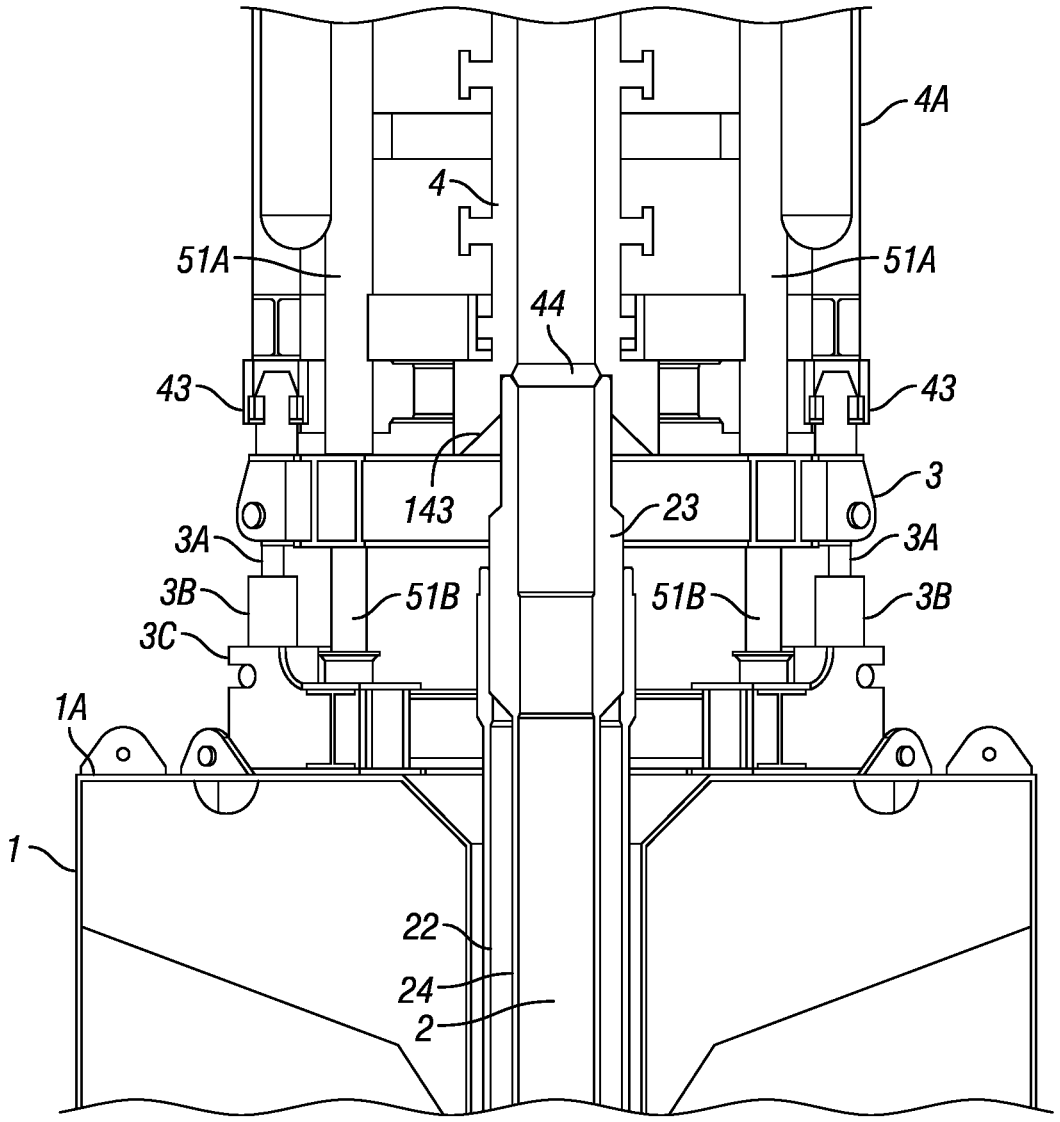
FIG. 3 shows the landing system of FIG. 2 wherein the connector is engaged with the wellhead.

FIG. 3 shows the situation where the connector 41 is in full contact with the HPWHH 23 after the linear motor (3A and 3B) is fully retracted. It is then possible to activate the connector 41 to sealingly engage the BOP 4 with the HPWHH 23.

A further possible benefit of the landing system according to the present disclosure is the capability of executing a so-called "over-pull test" on the connector 41. Once the connector 41 is activated and latched to the HPWHH 23, the connector 41 needs to be tested. One of these tests is to confirm that the connector 41 can withstand an axial uplift of the BOP 4 relative to the well 2 below. This test is usually performed by applying tension on the riser (not shown—connected to BOP 4 from above) from the platform on the water surface to compensate for all weight that is accumulated from the crane hook on the platform down to the connector 41. In addition to this accumulated weight a predetermined axial over-pull is applied. This axial over-pull represents the net force to which the connector 41 is tested. Taking into account all uncertainties in weights and environmental conditions it is much more exact to use the landing system (i.e., using the linear motor components 3A, 3B) to apply the predetermined upward axial force.

The total weight of the BOP 4 and riser (not shown) exerted onto the landing system can be measured once the BOP is landed, before the latches are activated. This can be used as a reference value to apply an exact "over-pull" onto the connector 41.

The landing system may form part of the heavy component (e.g., the BOP 4), therefore installed together with the heavy component, or part of the subsea structure, e.g., the well 2 or well foundation (anchor 1). It may be integrated into a suction anchor, on top of the top plate or completely integrated into the internals of the suction anchor 1 (for example, below the top plate) to prevent obstruction with other equipment such as x-mas trees, flow lines, tie-in points, etc. In the present example embodiment, the linear motor(s) are disposed between the landing system upper frame 3 and the landing system lower frame 3C, however, in other embodiments, the linear motor(s) may be disposed between the landing system and the BOP frame 4A or any equivalent structure for the heavy component.

The attachment between the landing system and the well 2 or the anchor 1 may be fixed, such as welded, bolted or connected by any other mean, or temporary. When the attachment is temporary, the activation/deactivation of the connection may be performed by ROV, by wire or any other means of communication or activation method. The activation/deactivation method may be energized by any possible means, for example mechanically, electrically or hydraulically.

A landing system and method according to the present disclosure may increase the range of weather conditions in which heavy components may be lowered and affixed to a well on the water bottom, may reduce the incidence of damage to the heavy components or corresponding well components and may increase efficiency of testing procedures used to confirm latching of the heavy components to the well.

Although only a few examples have been described in detail above, those skilled in the art will readily appreciate that many modifications are possible in the examples. Accordingly, all such modifications are intended to be included within the scope of this disclosure as defined in the following claims.

What is claimed is:

1. A landing system for a subsea structure, comprising:

a heavy component having a latch affixed thereto and having a mechanism attached to enable lowering the heavy component from a platform above the bottom of a body of water;

a landing system frame, the landing system frame comprising a connection point matable with the latch; and a linear motor functionally coupled to the landing system frame and at least one of the subsea well structure and a movable frame on the landing system, the linear motor operable to control a distance between the landing system frame and the at least one of the subsea structure and the movable frame on the landing system.

2. The landing system of claim 1 wherein the heavy component comprises a blowout preventer.

3. The landing system of claim 2 further comprising a connector associated with the blowout preventer, a seal assembly disposed in the connector and a seal bore extension coupled to an upper end of the subsea well, the connector and the seal bore extension sealingly engaged when the linear motor is retracted.

4. The landing system of claim 1 further comprising a damper disposed between the heavy component and the landing system frame.

5. The landing system of claim 4 wherein the damper comprises a piston engaged with a cylinder, the cylinder comprising a flow restrictor such that water is restrictedly movable through the cylinder in response to motion of the piston.

6. The landing system of claim 4 wherein the damper is tuned to be critically damped based on mass of the heavy component and a spring constant of the mechanism.

7. The landing system of claim 1 wherein the linear motor comprises an hydraulic piston and cylinder.

8. The landing system of claim 1 wherein the linear motor comprises a jack screw and ball nut.

9. The landing system of claim 1 further comprising a damper having a first component coupled to the heavy component and a second component coupled to the landing system frame.

10. The landing system of claim 1 wherein the landing system frame is affixed to the subsea structure.

11. The landing system of claim 10 wherein the subsea structure comprises a subsea well.

12. The landing system of claim 1 wherein the landing system frame is affixed to the heavy component to be landed on the bottom of water.

13. A method for landing a heavy component on to a subsea structure, comprising:

lowering the heavy component having a latch affixed thereto from a platform above the bottom of a body of water, wherein the subsea structure comprises a landing system frame, the landing system frame comprising a connection point matable with the latch, and a linear motor functionally coupled to the landing system frame and at least one of the subsea structure and a movable frame on the landing system, the linear motor operable to control a distance between the landing system frame and the at least one of the subsea well structure and the movable frame on the landing system;

locking the latch to the connection point; and operating the linear motor to move the heavy component toward the subsea structure.

14. The method of claim 13 wherein the heavy component comprises a blowout preventer.

15. The method of claim 14 further comprising a connector associated with the blowout preventer, a seal assembly disposed in the connector and a seal bore extension coupled to an upper end of the subsea well, the connector and the seal bore extension sealingly engaged when the linear motor is retracted.

16. The method of claim 13 further damping movement using a damper disposed between the heavy component and the landing system frame.

17. The method of claim 16 wherein the damper comprises a piston engaged with a cylinder, the cylinder comprising a flow restrictor such that water is restrictedly movable through the cylinder in response to motion of the piston.

18. The method of claim 16 wherein the damper is tuned to be critically damped based on mass of the heavy component and a spring constant of the mechanism.

19. The method of claim 13 wherein the linear motor comprises an hydraulic piston and cylinder.

20. The method of claim 13 wherein the linear motor comprises a jack screw and ball nut.

21. The method of claim 13 wherein the landing system frame is affixed to the subsea structure.

22. The method of claim 21 wherein the subsea structure comprises a subsea well.

23. The method of claim 13 wherein the landing system frame is affixed to the heavy component to be landed on the bottom of water.

* * * * *